US006601945B2

(12) United States Patent
Kitakami

(10) Patent No.: US 6,601,945 B2
(45) Date of Patent: Aug. 5, 2003

(54) INK JET RECORDING METHOD AND APPARATUS

(75) Inventor: Koichi Kitakami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 10/024,138

(22) Filed: Dec. 21, 2001

(65) Prior Publication Data

US 2002/0145642 A1 Oct. 10, 2002

(30) Foreign Application Priority Data

Dec. 28, 2000 (JP) ..... 2000-400964
Oct. 30, 2001 (JP) ..... 2001-332476

(51) Int. Cl.[7] ..... B41J 2/145; B41J 2/015
(52) U.S. Cl. ..... 347/40; 347/21
(58) Field of Search ..... 347/40, 21, 41–43, 347/48, 54

(56) References Cited

U.S. PATENT DOCUMENTS

| | | | |
|---|---|---|---|
| 4,313,124 | A | 1/1982 | Hara |
| 4,345,262 | A | 8/1982 | Shirato et al. |
| 4,459,600 | A | 7/1984 | Sato et al. |
| 4,463,359 | A | 7/1984 | Ayata et al. |
| 4,558,333 | A | 12/1985 | Sugitani et al. |
| 4,608,577 | A | 8/1986 | Hori |
| 4,723,129 | A | 2/1988 | Endo et al. |
| 4,740,796 | A | 4/1988 | Endo et al. |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 10-264367 | 10/1998 |

*Primary Examiner*—John Barlow
*Assistant Examiner*—An H. Do
(74) *Attorney, Agent, or Firm*—Fitzpatrick, Cella, Harper & Scinto

(57) ABSTRACT

An ink jet recording apparatus includes a recording head having one nozzle array or a plurality of nozzle arrays. Each nozzle array includes a plurality of nozzles. These nozzles include at least one end nozzle at at least one end of the nozzle array or arrays and ink nozzles other than the at least one end nozzle. The end nozzle discharges a windshield liquid and the ink nozzles discharge ink. The end nozzle prevents the displacement on a recording medium of ink droplets discharged from the outermost ink nozzle among the ink nozzles, thus forming a high-quality image without partial unevenness in recording density.

17 Claims, 14 Drawing Sheets

INK JET RECORDING METHOD AND APPARATUS

BACKGROUND OF THE INVENTION

1. Field of the Invention

The present invention relates to an ink jet recording method and an ink jet recording apparatus which can record high-quality images on a recording medium.

The method and apparatus in accordance with the present invention are applicable to any device using recording media such as paper, leather, nonwoven fabric, and OHP sheets. Examples of such devices include business machines such as printers, copying machines, and facsimile machines.

2. Description of the Related Art

Ink jet recording apparatuses, which emit little noise, can run at low operation costs, can be readily miniaturized, and can readily effect color printing, have been extensively used in, for example, printers and copying machines.

Trends in current ink jet printers are an increase in resolution of nozzles and a reduction in size of ink droplets to improve the quality of recording images. Other trends are increases in density and number of nozzles to increase printing rates.

The present inventors have found the following problems during studies for achieving the formation of high-quality color images by using smaller ink droplets which are suitable for high resolution recording heads.

That is, smaller ink droplets are readily affected by ambient air turbulence and are discharged onto positions which deviate from target positions. Such a phenomenon is significantly noticeable in a "full discharge" mode in which ink is discharged through all the mounted nozzles. Among the ink dots discharged from these nozzles in a nozzle array, ink dots discharged from the outermost positions relatively tend to deviate from the corresponding target positions. In discharge modes other than the full discharge mode, such displacement of discharged ink dots will readily occur as the number of the nozzles in the nozzle array increases, in other words, as the discharge density increases.

Such problems found by the present inventors must be solved for achieving higher-density recording particularly in color imaging.

SUMMARY OF THE INVENTION

The present invention can provide an ink jet recording method and an ink jet recording apparatus which can reduce localized recording unevenness due to the displacement of discharged ink positions in recording images and which can provide high-quality images.

According to an aspect of the present invention, a method of ink jet recording includes the steps of discharging an ink from a recording head having at least one nozzle array including a plurality of nozzles for performing recording on a recording medium, and discharging a liquid other than ink from at least two nozzles of the at least one nozzle array of the recording head, wherein the ink is discharged from the inner nozzles of the at least one nozzle and the at least two nozzles for discharging the liquid are disposed at outside of the inner nozzles in the at least one nozzle array.

According to another aspect of the present invention, an ink jet recording apparatus includes a recording head having at least one nozzle array including a plurality of nozzles, the plurality of nozzles including nozzles for discharging an ink and nozzles for discharging a liquid other than ink, wherein the liquid other than ink is discharged from at least two nozzles of the at least one nozzle array and the ink is discharged from inner nozzles adjacent to the at least two nozzles to perform recording onto a recording medium, the at least two nozzles being disposed at outside of the inner nozzles in the at least one nozzle array.

According to the present invention, the colorless liquid droplet functions as a "windshield liquid droplet" and prevents the displacement on a recording medium of the ink droplet discharged from the outermost position in a high-density "full discharge" mode, even when the ink droplet has a fine volume. Thus, the recorded image exhibits high resolution without partial unevenness of recording density.

Further objects, features and advantages of the present invention will become apparent from the following description of the preferred embodiments with reference to the attached drawings.

DESCRIPTION OF THE PREFERRED EMBODIMENTS

Figure 1:
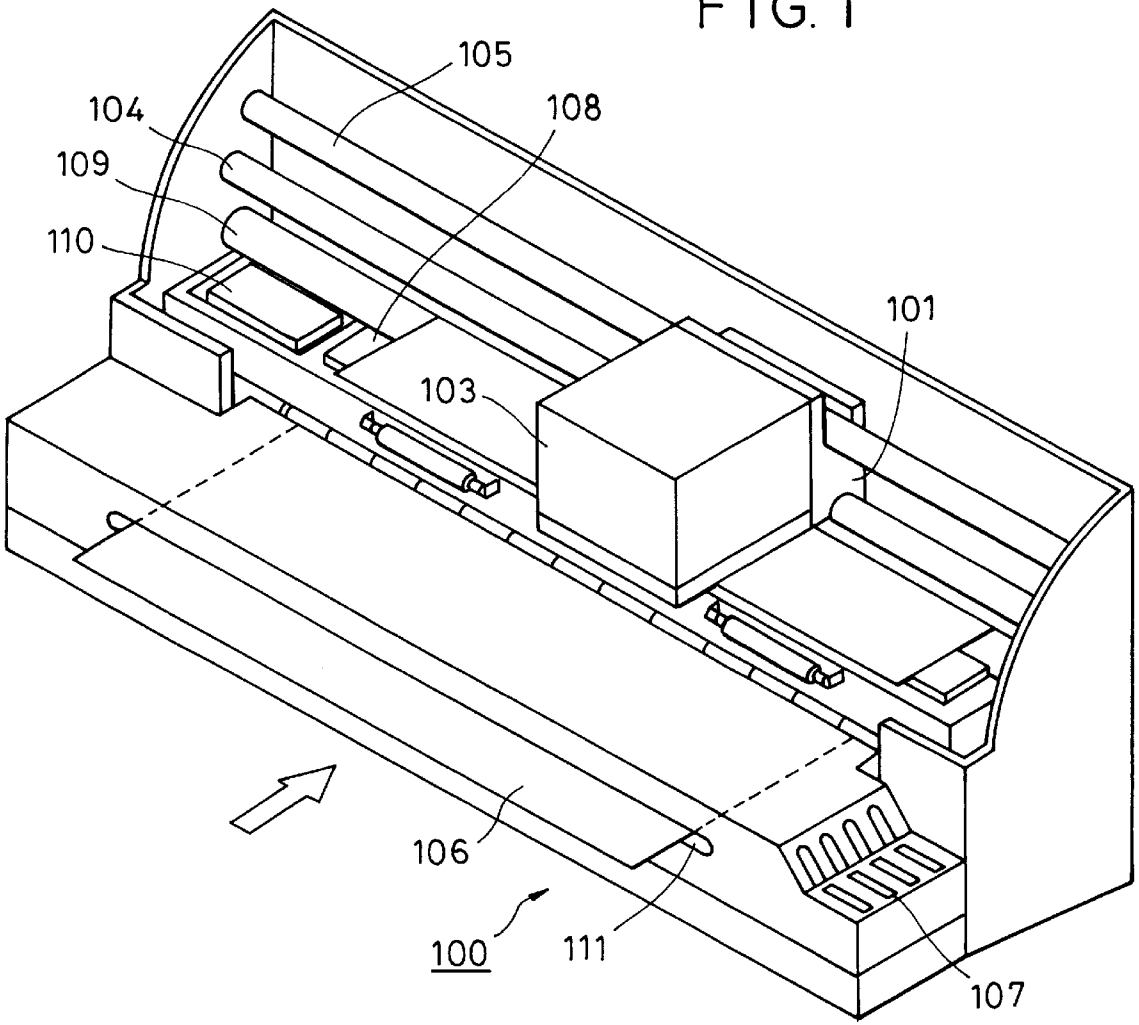
FIG. 1 is an outline isometric view of an ink jet recording apparatus according to the present invention.

FIG. 1 is an outline isometric view of an ink jet recording apparatus 100 according to the present invention. A recording medium 106 which is inserted at a feeding position of the recording apparatus 100 is transferred to a recording region of a recording head unit 103 by a feeding roller 109. A platen 108 is provided below the recording medium 106 in the recording region. A carriage 101, supported by two guide shafts 104 and 105, moves in a direction of the guide shafts 104 and 105 (main scanning direction) to scan across the recording region in a reciprocating motion. Herein, the scanning direction of the carriage 101 is referred to as the main scanning direction, whereas the transfer direction of the recording medium 106 is referred to as the sub scanning direction. The carriage 101 accommodates the recording head unit 103 which includes recording heads for discharging a plurality of color ink droplets and windshield droplets and reservoirs for supplying inks and a windshield liquid to the respective recording heads. Herein, the windshield liquid is substantially colorless. In each recording head, a nozzle for discharging ink droplets is referred to as an "ink discharge nozzle" and a nozzle for discharging windshield droplets is referred to as a "windshield droplet discharge nozzle" (or "windshield liquid discharge nozzle"). In this embodiment, the ink jet recording apparatus contains four color inks of black (Bk), cyan (C), magenta (M), and yellow (Y).

The recording apparatus 100 is provided with a recovery unit 110 at the left bottom of the region in which the carriage 101 can move. The recovery unit 110 covers the nozzle section of the recording head in a nonrecording mode. This left bottom position is referred to as a home position. The recording apparatus 100 is further provided with a switch and display section 107 which is used for switching the power supply of the recording apparatus on and off, changing various recording modes, and displaying the status of the recording apparatus.

Figure 2:
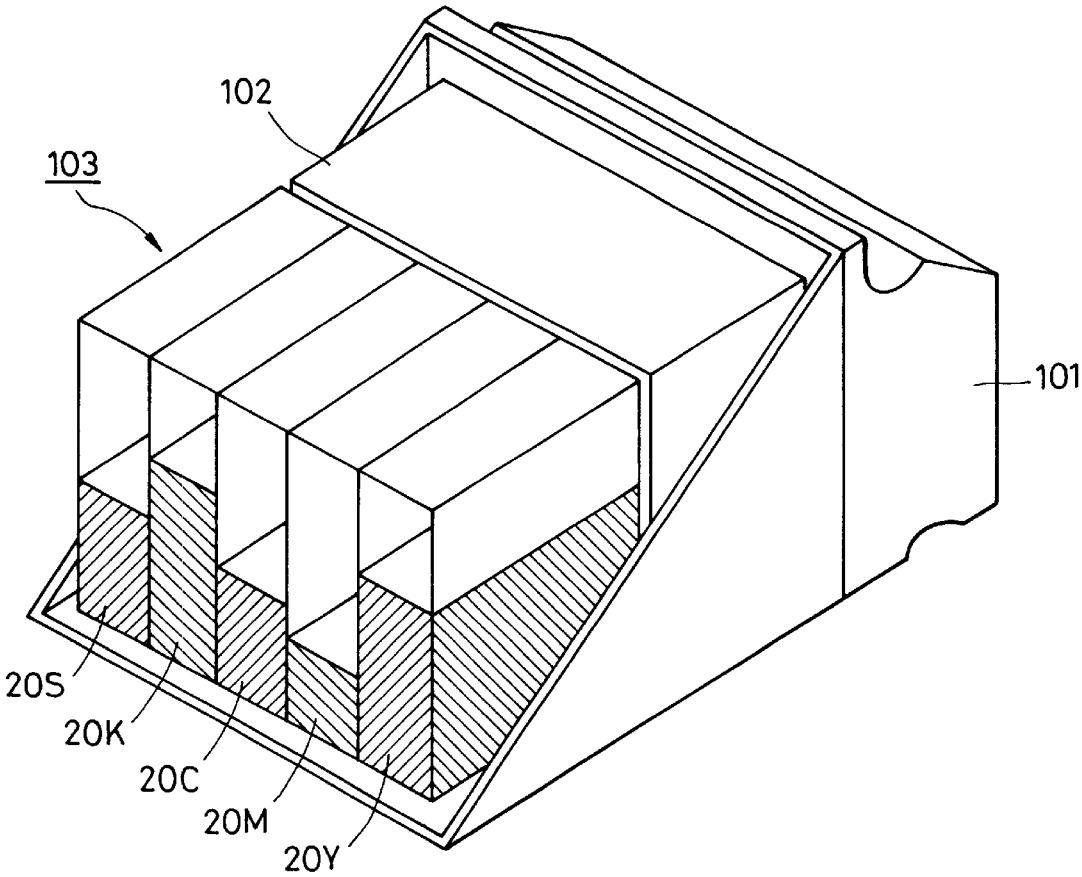
FIG. 2 is an outline isometric view of an ink jet recording head according to the present invention.

FIG. 2 is an outline isometric view of the recording head unit 103. In this embodiment, the black, cyan, magenta, and yellow ink reservoirs and the windshield liquid reservoir are independently replaceable with new ones. The carriage 101 includes a recording head group 102, a black ink reservoir 20K, a cyan ink reservoir 20C, a magenta ink reservoir 20M, a yellow ink reservoir 20Y, and a windshield liquid reservoir 20S. The recording head group 102 discharges a combination of windshield liquid droplets and black ink droplets, a combination of the windshield liquid droplets and cyan ink droplets, a combination of the windshield liquid droplets and magenta ink droplets, and a combination of the windshield liquid droplets and yellow ink droplets. These reservoirs are connected to the recording head group 102 for supplying the inks and the windshield liquid to channels which communicate with nozzles in the recording head group 102. In another preferred embodiment of the present invention, these color ink reservoirs and the windshield liquid reservoir may be integrated in any combination.

Figure 3A:
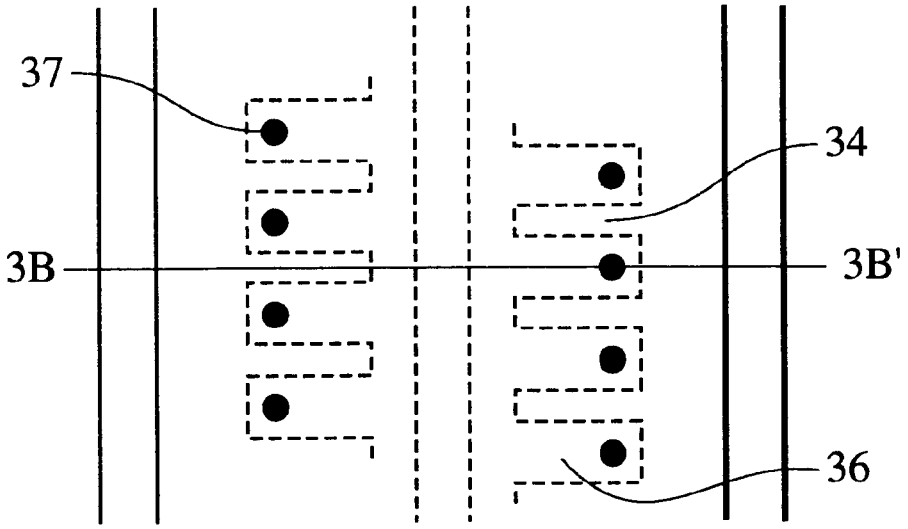
FIGS. 3A and 3B are a plan view and a cross-sectional view, respectively, of an ink jet recording head according to the present invention.
Figure 3B:
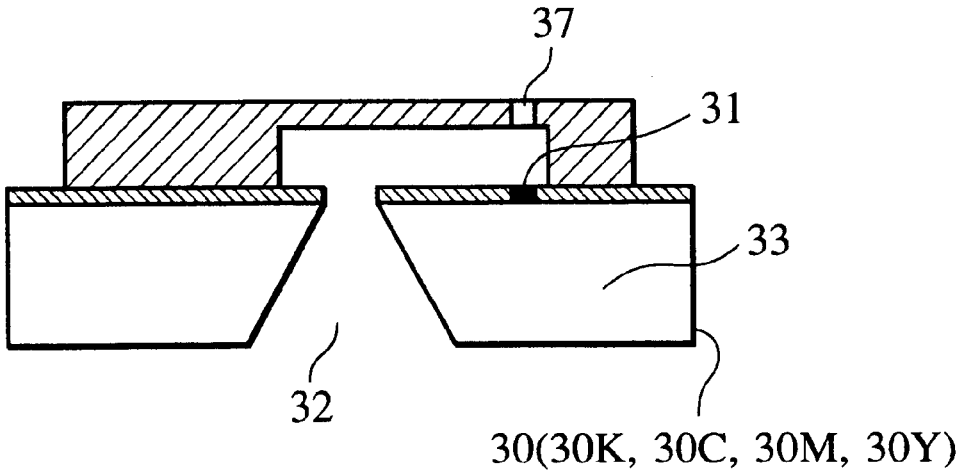

FIG. 3A is a plan view of the recording head group 102 and FIG. 3B is a cross-sectional view of the recording head group 102 at a position of a heating element, taken from line 3B-3B' in FIG. 3A.

In the ink jet recording apparatus according to this embodiment, a heating element 31, which is a electrothermal transducer, is provided at a position corresponding to each nozzle 37 of the recording head group 102. A driving signal in response to recording information is applied to the heating element 31 to discharge an ink droplet or a windshield liquid droplet through the nozzle 37. The heating elements 31 for the corresponding nozzles 37 can be independently energized.

Figure 4:
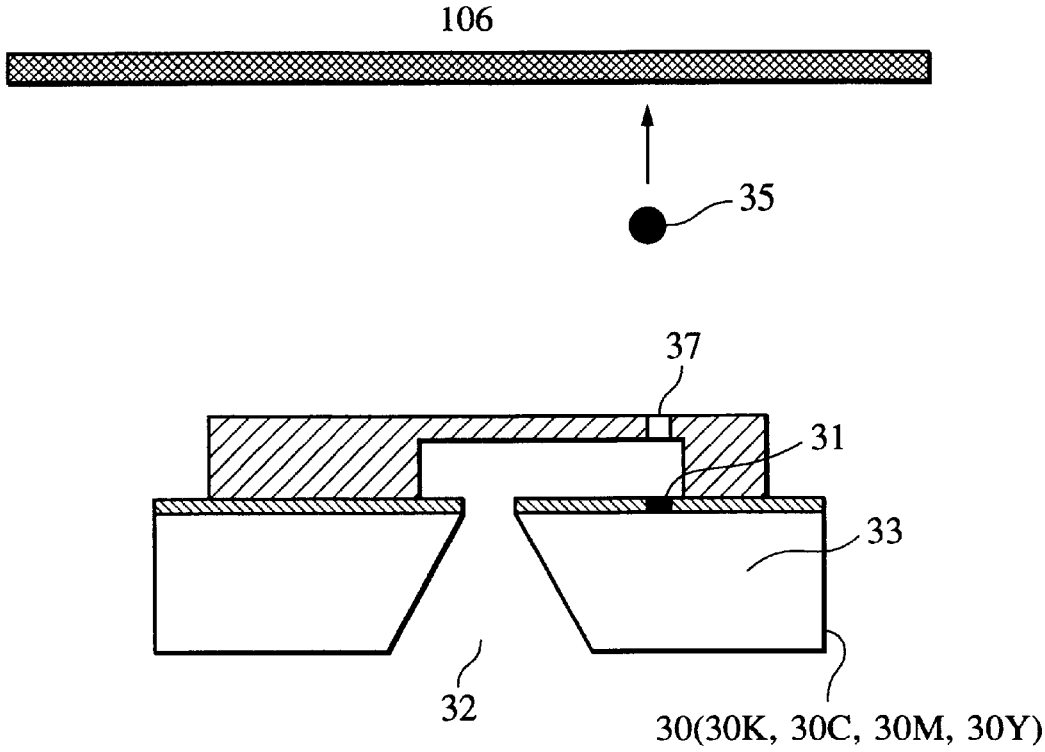
FIG. 4 is a cross-sectional view of an ink jet recording head used in the present invention.

The inks and the windshield liquid are rapidly heated in the nozzles by heat from the heating elements 31 to generate bubbles by film boiling. As a result of a change in volume due to such bubbling, as shown in FIG. 4, an ink or windshield liquid droplet 35 is discharged toward the recording medium 106 to form a character or image on the recording medium 106. Each nozzle 37 communicates with a channel for the ink or windshield liquid, and each channel communicates with a common liquid chamber. The common liquid chamber supplies the ink or windshield liquid to the channel. The channel for the nozzle 37 is provided with the heating element 31 which generates heat for discharging the ink or windshield liquid through the nozzle 37 and electrode leads which supply electrical power to the heating element 31. The heating elements 31 and the electrode leads are formed on a substrate 33 composed of silicon or the like by a deposition process. The heating element 31 is covered with a protective film which prevents the ink or windshield liquid from direct contact with the heating element 31. Moreover, a diaphragm 34 and a separator 39 (see FIGS. 6A and 6B), which are composed of resin or glass, are deposited on the substrate 33 to constitute the nozzle 37, a channel 36, and a common liquid chamber 32.

Current ink jet printers are provided with higher-resolution nozzles which discharge finer ink droplets for achieving higher-quality image recording. Moreover, the density and the number of the nozzles are increasing to meet high-speed printing. Such high-speed printing by the increase in the density and the number of the nozzles is achieved only by a full discharge mode in which inks are discharged through all the mounted nozzles. In the full discharge mode, however, ink dots discharged from the outermost positions among the discharged ink dots from these nozzles in a nozzle array tend to shift toward the inner side, resulting in a new problem of deterioration of printing quality.

Such a problem is based on crosswind which occurs on the discharge face and blows perpendicularly to the main scanning direction. The effect of the crosswind will become noticeable with a decrease in mass of the ink droplet due to a reduction in size thereof.

Since the ink droplets discharged from the nozzles lying at the outermost positions of the nozzle array are readily affected by the crosswind compared with ink droplets discharged from the other inner nozzles, as described above, the discharged ink positions readily deviate from the target positions, resulting in deterioration of ink discharge precision. Thus, in the configuration according to the present invention, the windshield liquid is discharged at the exterior of the outermost ink droplets so that the outermost ink droplets are not affected by crosswind. In other words, additional nozzles for discharging the windshield liquid are provided at the exterior of the outermost nozzles for discharging inks. The windshield liquid, which moderates the effect of the crosswind, is substantially colorless. This outermost colorless liquid undergoes displacement of from its intended target position in a full-discharge printing mode. Since the colorless liquid undergoes such displacement, the colorless liquid droplets must be discharged synchronously with ink droplets for forming an image and are required not to affect the ink droplets on the recording medium 106.

Any "windshield liquid" satisfying such requirements may be used in the present invention; however, a "substantially colorless liquid" is preferable since this liquid does not cause deterioration of the quality of the image formed of inks. For example, a preferable colorless liquid is a processing liquid disclosed in Japanese Laid-Open Patent Publication No. 10-264367.

In the foregoing document, the processing liquid is added to insolubilize or coagulate coloring agents in the inks so that the density, water resistance, and coloring property, which contribute to an improvement in printing quality, are improved. For anionic inks, the processing liquid preferably contains at least one cationic substance to enhance the above effects. Any cationic substance having a cationic group or cationic groups may be used in the present invention. Among the cationic substances, polyallylamines are particularly preferred. A combination of a polyallyamine and a low-molecular-weight cationic surfactant is more preferable in view of suppression of boundary color mixing in a color recording mode. Non-limiting examples of low-molecular-weight cationic surfactants include cetyltrimethylammonium chloride, lauryltrimethylammonium chloride, lauryldimethylbenzylammonium chloride, benzyltributylammonium chloride, and benzalkonium chloride.

In the following embodiments and comparative example, inks and a processing liquid having the following compositions were used. Ingredients used were thoroughly mixed and then the mixture was filtered under pressure using a Fluoropore filter having a pore size of 0.22 $\mu$m (Commercial Name, made by Sumitomo Electric Industries, Ltd.) to form each ink or the processing solution. The following exemplary compositions represent a preferred embodiment of the present invention, but any other compositions may also be used in the present invention.

| | |
|---|---|
| Yellow Ink | |
| Glycerin | 5.0 weight percent |
| Thiodiglycol | 5.0 weight percent |
| Urea | 5.0 weight percent |
| Isopropyl alcohol | 4.0 weight percent |
| Dye: C.I. Direct Yellow 142 | 2.0 weight percent |
| Water | 79.0 weight percent |
| Magenta Ink | |
| Glycerin | 5.0 weight percent |
| Thiodiglycol | 5.0 weight percent |
| Urea | 5.0 weight percent |
| Isopropyl alcohol | 4.0 weight percent |
| Dye: C.I. Acid Red 289 | 2.5 weight percent |
| Water | 78.5 weight percent |
| Cyan Ink | |
| Glycerin | 5.0 weight percent |
| Thiodiglycol | 5.0 weight percent |
| Urea | 5.0 weight percent |
| Isopropyl alcohol | 4.0 weight percent |
| Dye: C.I. Direct Blue 199 | 2.8 weight percent |
| Water | 78.2 weight percent |
| Black Ink | |
| Glycerin | 5.0 weight percent |
| Thiodiglycol | 5.0 weight percent |
| Urea | 5.0 weight percent |
| Isopropyl alcohol | 4.0 weight percent |
| Dye: C.I. Food Black 2 | 1.0 weight percent |
| Dye: C.I. Direct Black 195 | 2.0 weight percent |
| Water | 78.0 weight percent |
| Processing Liquid | |
| Polyallyamine Chloride | 5.0 weight percent |
| Benzalkonium Chloride (Cation G50, made by Sanyo Chemical Industries, Ltd.) | 1.0 weight percent |
| Diethylene glycol | 10.0 weight percent |
| Water | 84.0 weight percent |

First Embodiment

Figure 5:
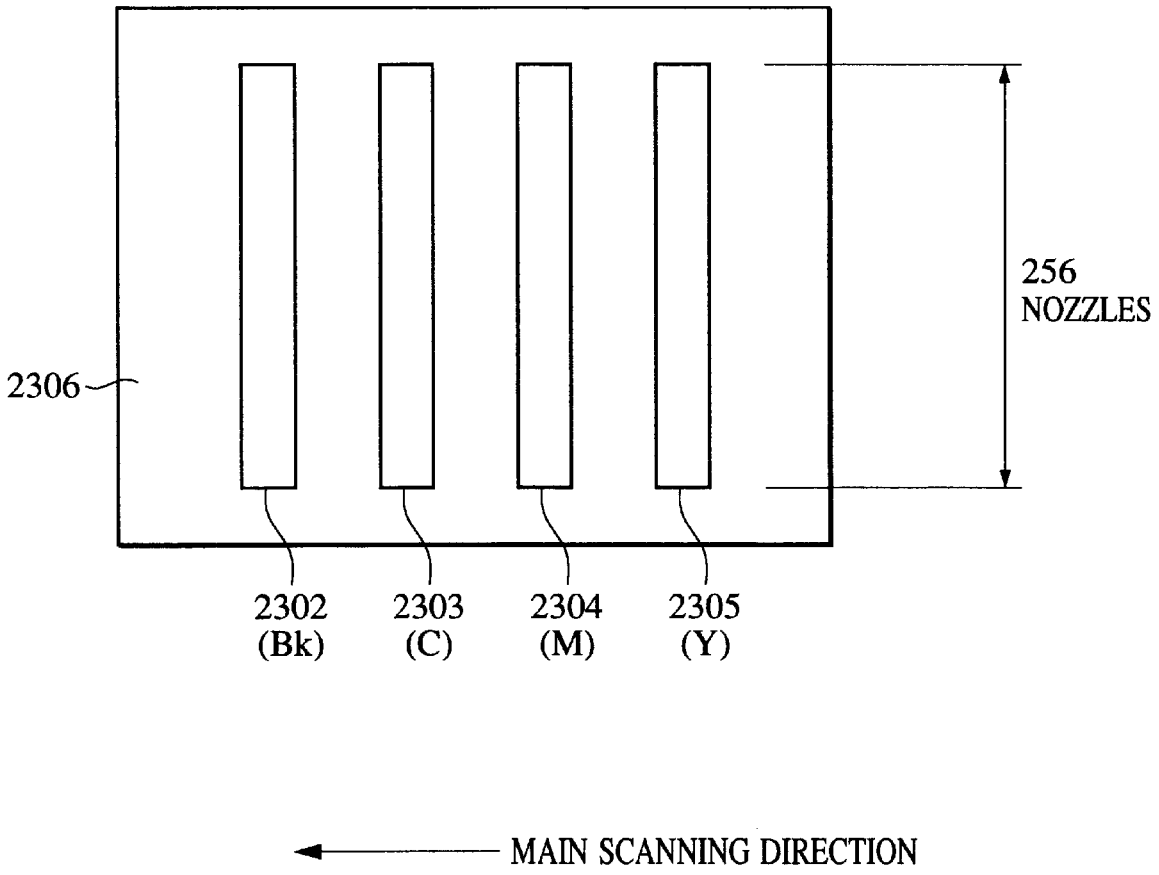
FIG. 5 is a schematic top view of an ink jet head unit according to a first embodiment of the present invention.

FIG. 5 shows a recording head unit used in a first embodiment. This recording head unit includes a black (Bk) chip 2302, a cyan (C) chip 2303, a magenta (M) chip 2304, and a yellow (Y) chip 2305, which are fixed on a frame 2306. These chips 2302 to 2305 have the same configuration as that of the print heads 30K, 30C, 30M, and 30Y shown in FIGS. 3A and 3B. These chips are arranged side-by-side in the main scanning direction at intervals of ½ inch. Each chip has a nozzle array including 256 nozzles (each nozzle is the same as the nozzle 37 shown in FIG. 4). These nozzles in each nozzle array are aligned in a direction substantially perpendicular to the main scanning direction.

Each nozzle array consists of two nozzle rows each including 128 nozzles at a pitch of about 42 $\mu$m. These two rows are arranged in a staggered form. In other words, each row is shifted by a half pitch (about 21 $\mu$m) from an adjacent row. This nozzle array arrangement allows recording of a 256-nozzle band with a resolution of 1,200 dpi by one main scanning operation (see FIGS. 6A and 6B).

Figure 6A:
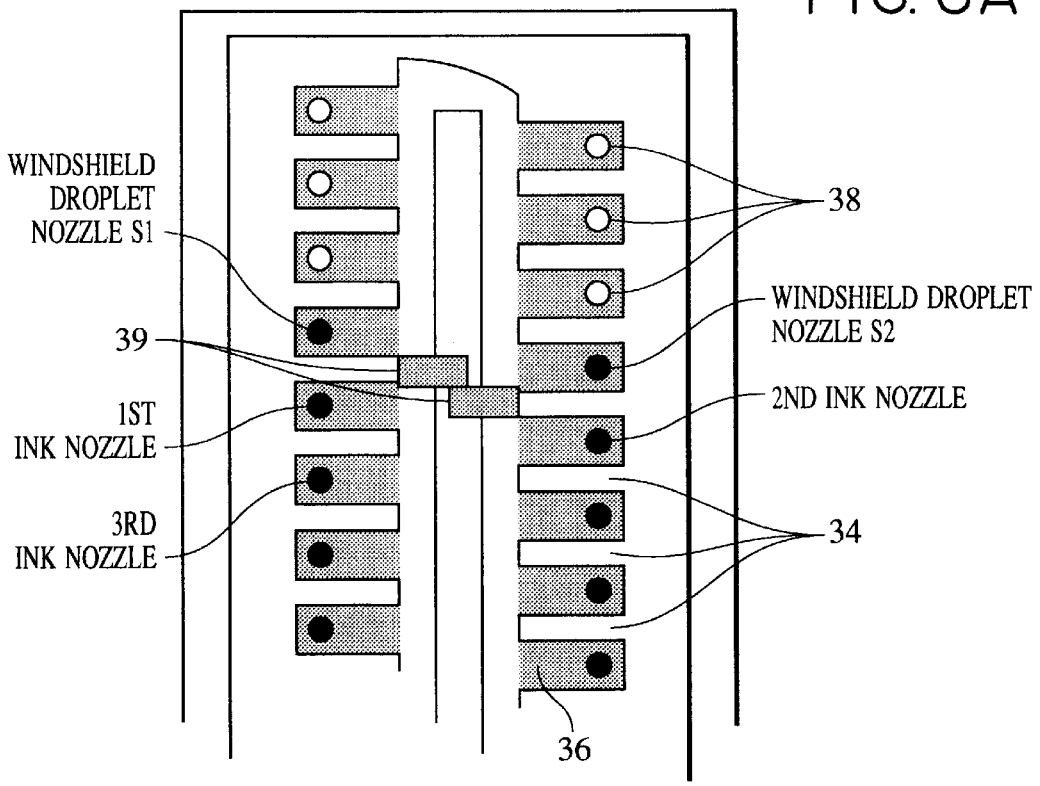
FIGS. 6A and 6B are plan views of the top and the bottom, respectively, of an ink jet head according to the first embodiment of the present invention.
Figure 6B:
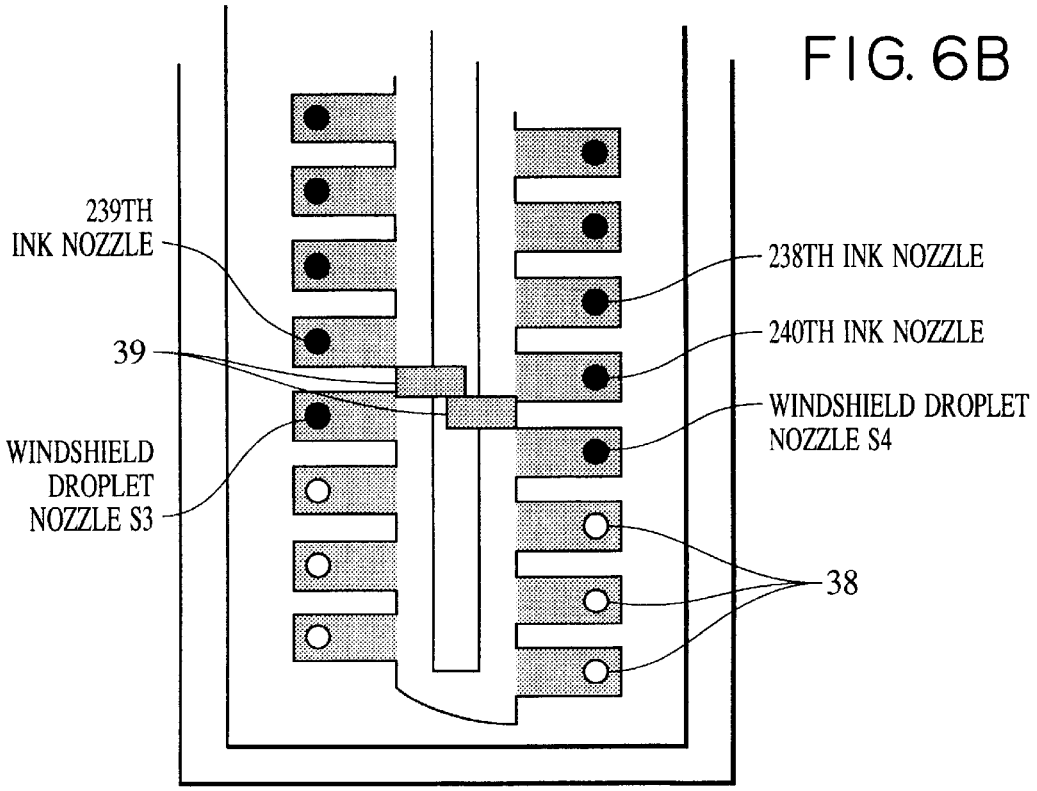

FIGS. 6A and 6B show the arrangement of the nozzles of an ink jet head according to the first embodiment of the present invention. In each of these two staggered nozzle rows, four nozzles at the top end and four nozzles at the bottom end, namely, eight nozzles in total are used as "windshield droplet discharge nozzles" (or "windshield liquid discharge nozzles"). The other nozzles are used as ink discharge nozzles. As shown in FIGS. 6A and 6B, windshield droplets are discharged only from windshield droplet discharge nozzles S1, S2, S3, S4. The other six windshield droplet discharge nozzles 38 at both ends contain, but do not discharge, the windshield droplets because these dummy windshield droplet discharge nozzles are provided to ensure sufficient communication with the corresponding common liquid chamber and achieve stable discharge of the windshield liquid. Accordingly, the eight nozzles at the both ends are used as the windshield droplet discharge nozzles.

Since the windshield droplet discharge nozzles discharge the windshield liquid, inks discharged from the inner nozzles are not affected by crosswind. As a result, ink droplets can exactly reach target positions to form a high-quality image without color mixing.

In the first embodiment, the four nozzles at each end are used as the windshield droplet discharge nozzles. However, the number of the windshield droplet discharge nozzles can be varied in the present invention. If a large number of nozzles at both ends are used as the windshield droplet discharge nozzles, the printing speed decreases due to a decrease in available ink discharge nozzles. Accordingly, the number of the windshield droplet discharge nozzles and the number of the ink discharge nozzles may be determined in view of a balance between the suppression of the effect of the crosswind and the printing speed.

In the present invention, as described above, at least one nozzle at each end of one row may be used for discharging the windshield liquid, and the other nozzles are used for discharging the inks. In such a case, a plurality of nozzles at each end may be used as "end nozzles" for discharging the windshield liquid or only one nozzle at each end may be used as an "end nozzle" for discharging the windshield liquid.

Figure 7:
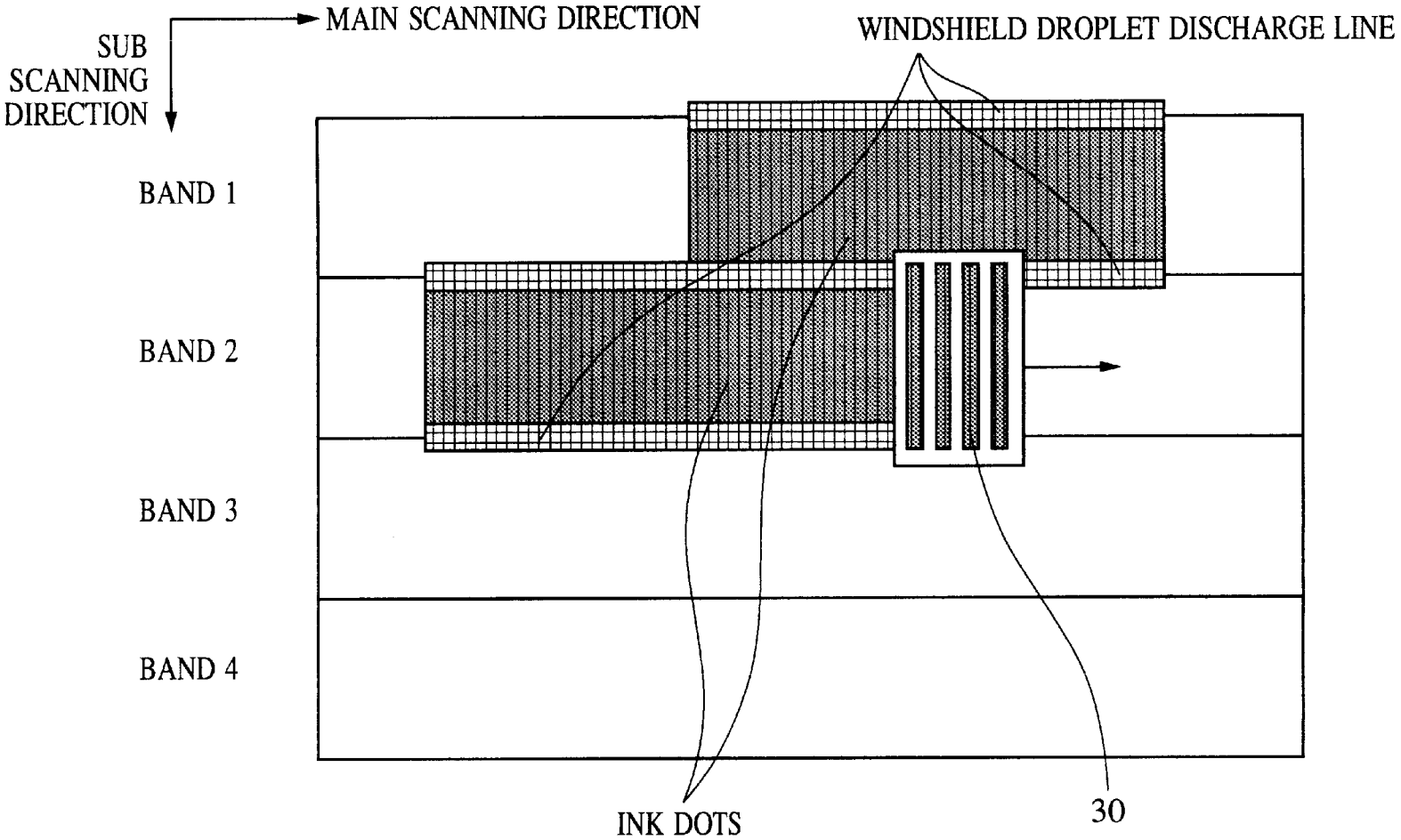
FIG. 7 is a schematic view illustrating solid-image printing using the ink jet head according to the first embodiment of the present invention.
Figure 8:
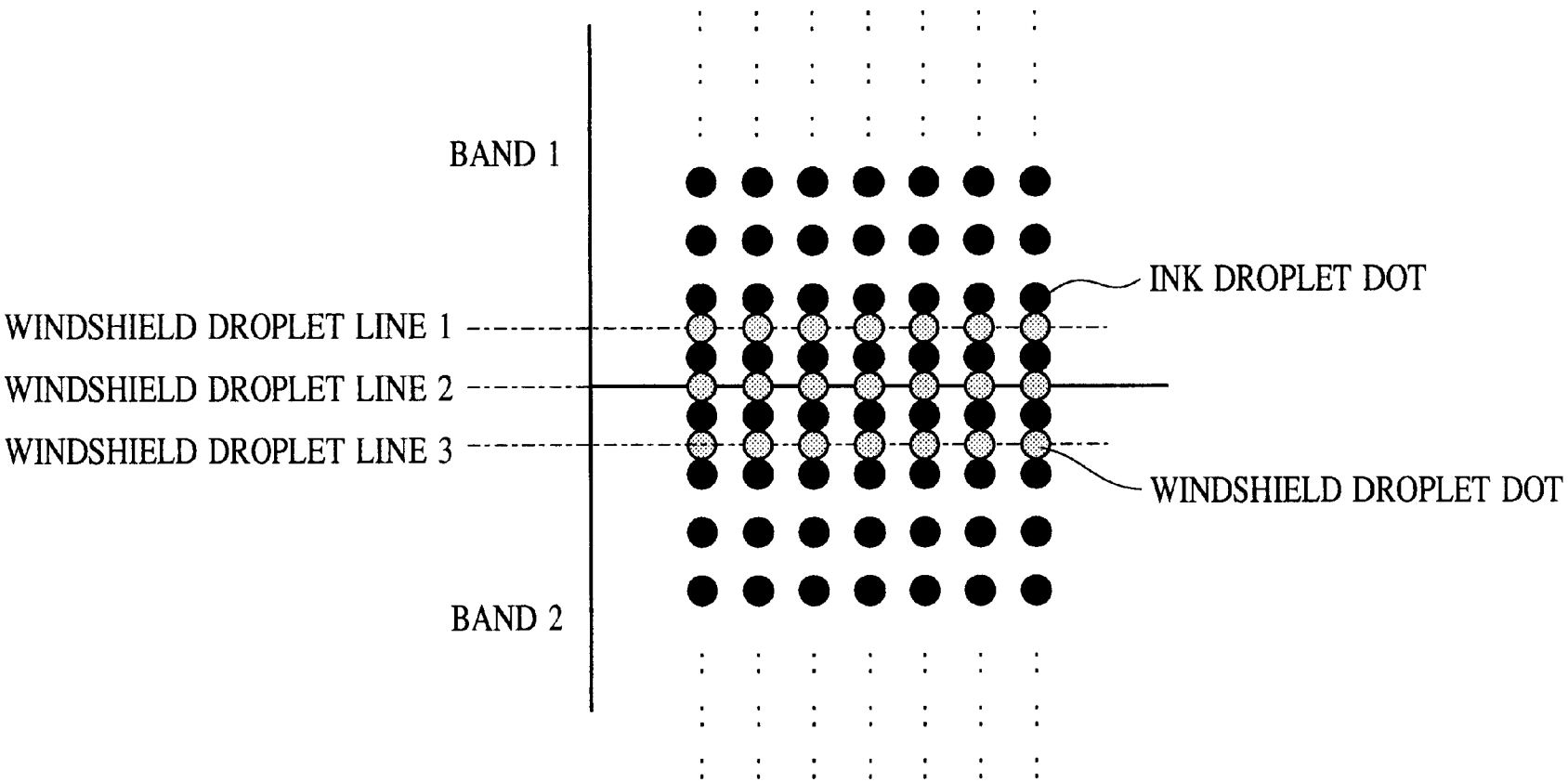
FIG. 8 is an enlarged schematic view illustrating the solid-image printing using the ink jet head according to the first embodiment of the present invention.

With reference to FIG. 7, a cyan (C) solid-image was printed using this recording head unit, wherein the number of effective pixels (=the number of dots or nozzles) defining the band width was 240 (=256 (total nozzles)−8×2 (dummy nozzles 38 and windshield droplet discharge nozzles)). FIG. 8 is an enlarged schematic view illustrating the printed solid image. In FIG. 8, the bottom-most ink-dots in Band 1 are formed of ink droplets discharged from the 240th ink discharge nozzle during the first main scanning operation, and the top-most ink-dots in Band 2 are formed of ink droplets discharged from the first ink discharge nozzle during the second main scanning operation.

The windshield droplet dots in FIG. 8 will now be described. The windshield droplet dots in this embodiment are colorless and do not contribute to the formation of images. A windshield droplet line 1 in FIG. 8 is formed of droplets discharged from the windshield droplet nozzle S3 during the first main scanning operation. A windshield droplet line 2 is formed of droplets discharged from the windshield droplet nozzle S4 during the first main scanning operation and droplets discharged from the windshield droplet nozzle S1 during the second main scanning operation. Also, a windshield droplet line 3 is formed of droplets discharged from the windshield droplet nozzle S2 during the second main scanning operation.

Since the windshield droplets discharged from the windshield droplet nozzles S1 to S4 are preferentially affected by crosswind in solid-image printing during a full discharge mode, ink droplets, which are discharged from the inner nozzles, reach target positions. The displacement of the windshield liquid droplets discharged from the windshield droplet nozzles S1 to S4 from the target positions is adjusted to be about one quarter of the nozzle pitch. As a result, the windshield droplet dots slightly overlap with ink dots on the recording medium.

As described above, in the solid-image printing which is performed using the head according to the first embodiment, displacement or disorder in the ink droplet dot arrangement cannot be visually observed. The printed solid image is of good quality and will not appear to have uneven density from macroscopic viewpoint.

The displacement δ of the windshield droplet dots was adjusted to one quarter of the nozzle pitch by controlling the discharge rate W of the windshield droplets according to equations (1) and (2):

$$t=L/W \quad (1)$$

$$\delta=V\times t \quad (2),$$

wherein V represents the lateral component of the discharge speed of the windshield droplets, L represents the distance to paper, and t represents the flight time of the droplet. The lateral component V is an inherent parameter which is determined by the shape of the recording head unit, the moving rate (carriage rate), and the shape of the moving space (in the casing). Thus, the displacement δ can be controlled by varying the discharge rate W. When the discharge rate W of the windshield droplets is remarkably different from the discharge rate Wi of the ink droplets, the discharge rate Wi of the ink droplets must be equal to the discharge rate W of the windshield droplets as much as possible. These discharge rates W and Wi can be varied by controlling the discharge power, such as the input power for heaters.

In ink discharge modes other than the "full discharge" mode, some nozzles are in a waiting state. In such a state, the crosswind is not significant, so that the ink droplets less deviate. Thus, the windshield droplets may be controlled not to be discharged in these modes in order to efficiently use the windshield liquid. In other words, the substantially colorless windshield liquid is discharged from all of the end discharge nozzles when the ink droplets are discharged from the other nozzles, whereas the windshield liquid is not discharged when the ink droplets are discharged only from a portion of the other nozzles. As a result, the consumption of the windshield liquid is reduced, and the displacement of the ink by the crosswind is moderated.

Comparative Example

Figure 9:
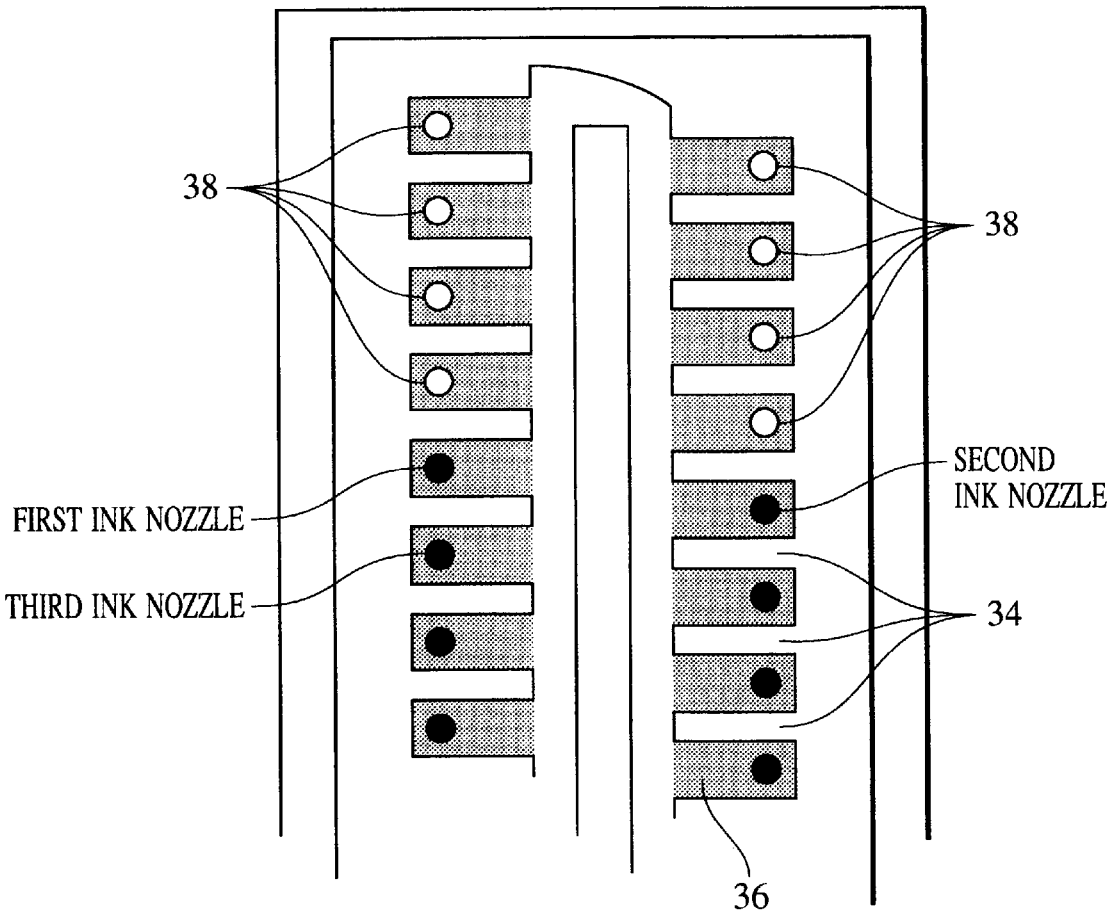
FIG. 9 is a plan view of the top of an ink jet head according to a comparative example.
Figure 10:
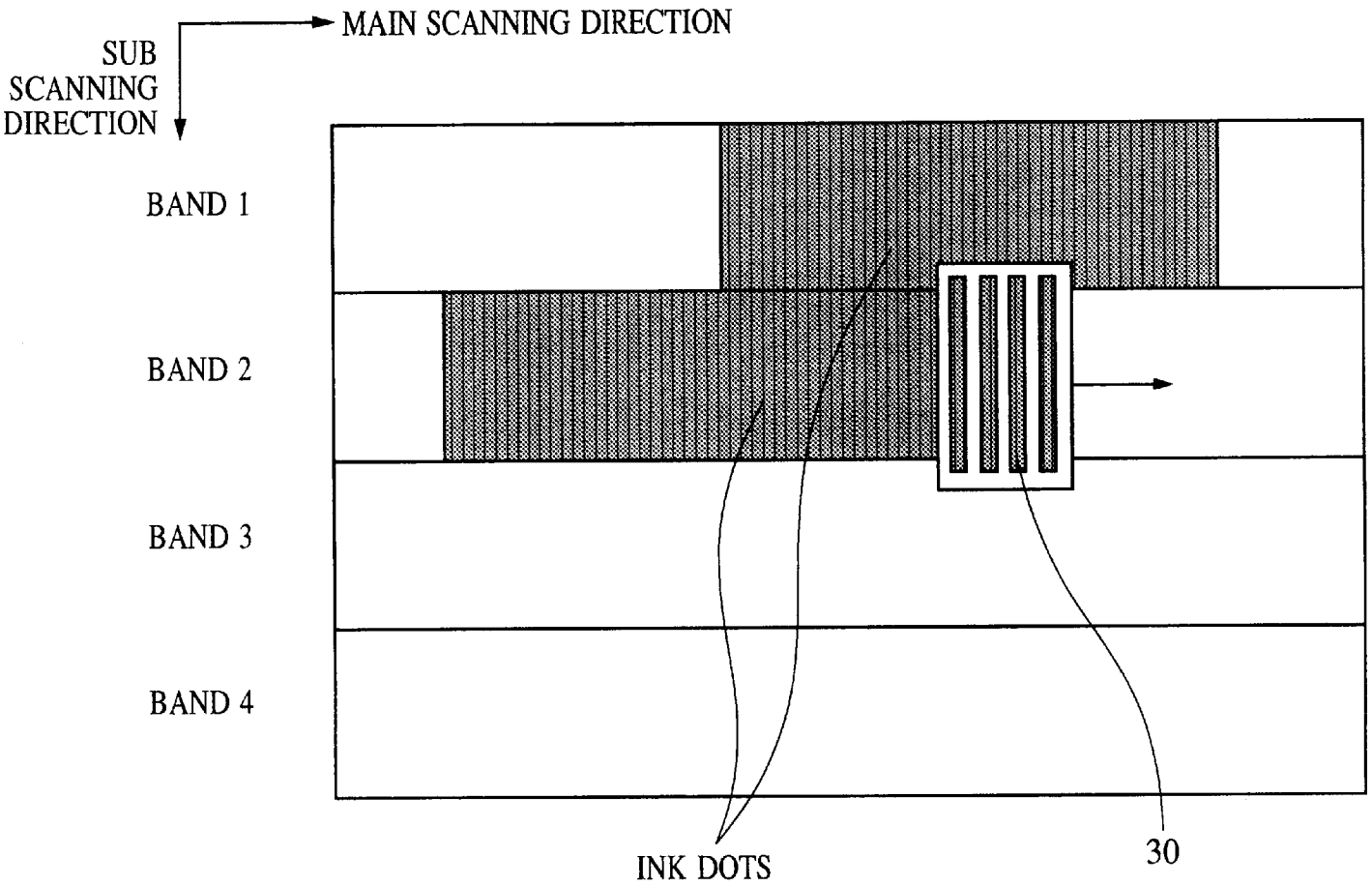
FIG. 10 is a schematic view illustrating solid-image printing using the ink jet head according to the comparative example.
Figure 11:
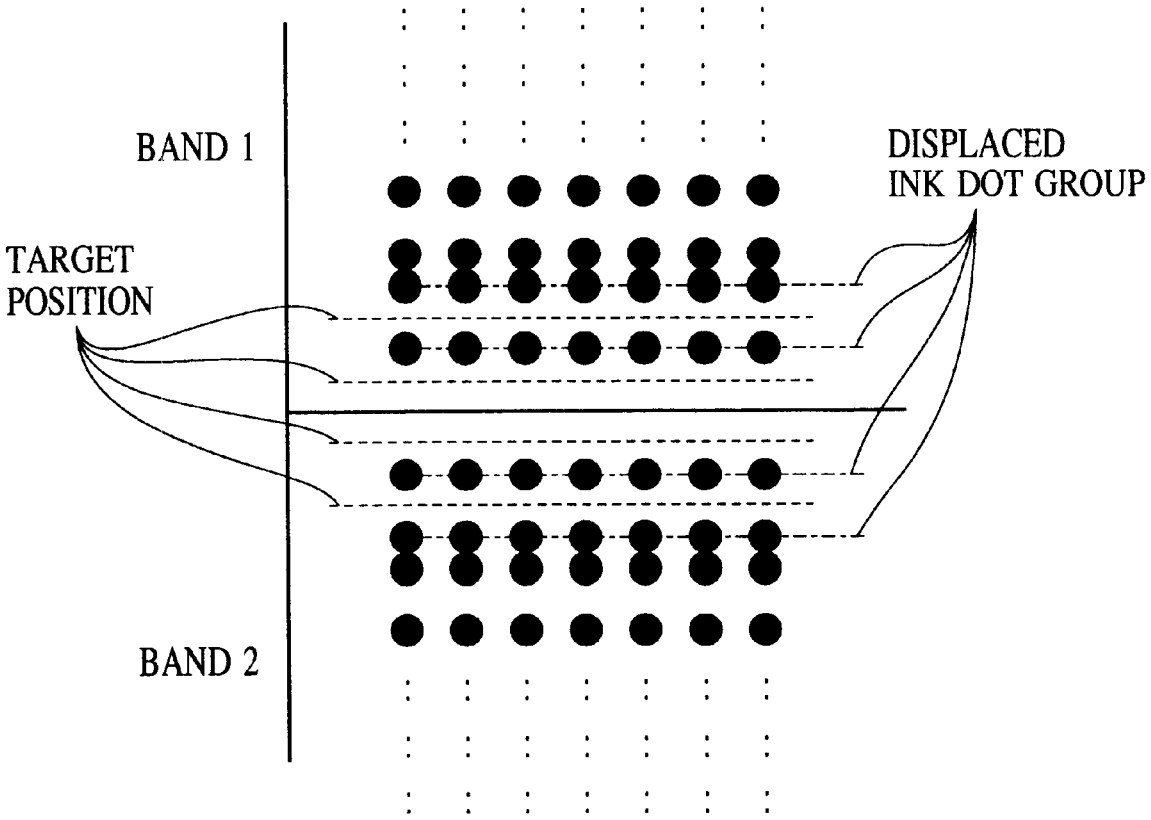
FIG. 11 is an enlarged schematic view illustrating the solid-image printing using the ink jet head according to the comparative example.

FIG. 9 is a plan view of the top of an ink jet head according to a comparative example. Herein, all the nozzles having a staggered arrangement were used as "ink discharge nozzles". Eight end nozzles (dummy nozzles) 38 contained but did not discharge inks during the discharge mode. The number of the effective pixels (the number of the dots or nozzles) defining the band width was 240 as in the first embodiment. A solid image was printed using this recording head unit (see FIG. 10). FIG. 11 is an enlarged schematic view illustrating the resulting solid image, in which dots in the drawing represent ink dots forming the solid image. The bottommost ink-dots in Band 1 are formed of ink droplets discharged from the 240th ink discharge nozzle during the first main scanning operation, and the ink-dots in the second row from the bottom in Band 1 are formed of ink droplets discharged from the 239th ink discharge nozzle during the first main scanning operation. Also, the topmost ink-dots in Band 2 are formed of ink droplets discharged from the 1st ink discharge nozzle during the second main scanning operation, and the ink-dots in the second row from the top in Band 2 are formed of ink droplets discharged from the 2nd ink discharge nozzle during the second main scanning operation.

As shown in FIG. 11, the dots discharged from the 1st, 2nd, 239th, and 240th nozzles deviate from the corresponding target positions by the effect of the crosswind. As a result, the distance between the bottommost dots in the band 1 and the topmost dots in the band 2 at the boundary is greater than that between any other two adjoining rows of dots. Such a phenomenon can be visually observed as regular lines in the solid image.

Second Embodiment

Figure 12:
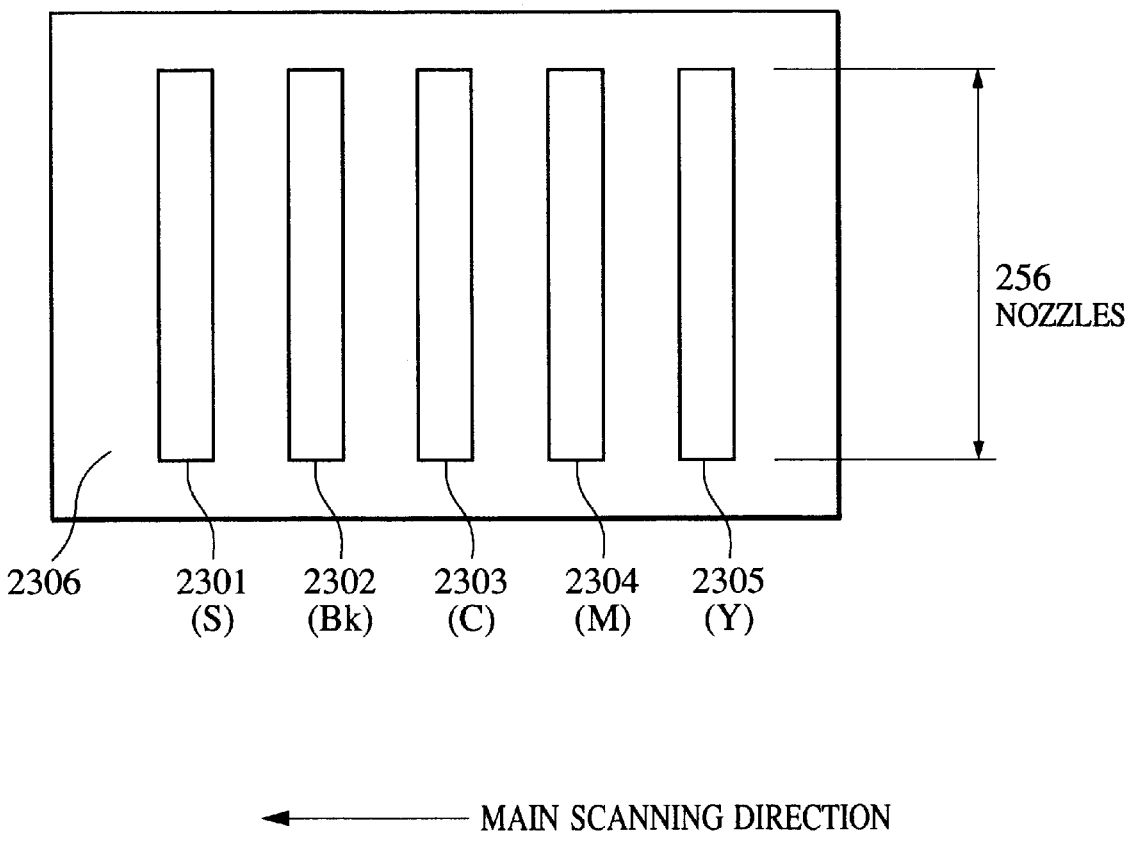
FIG. 12 is a schematic top view of an ink jet head unit according to a second embodiment of the present invention.
Figure 13:
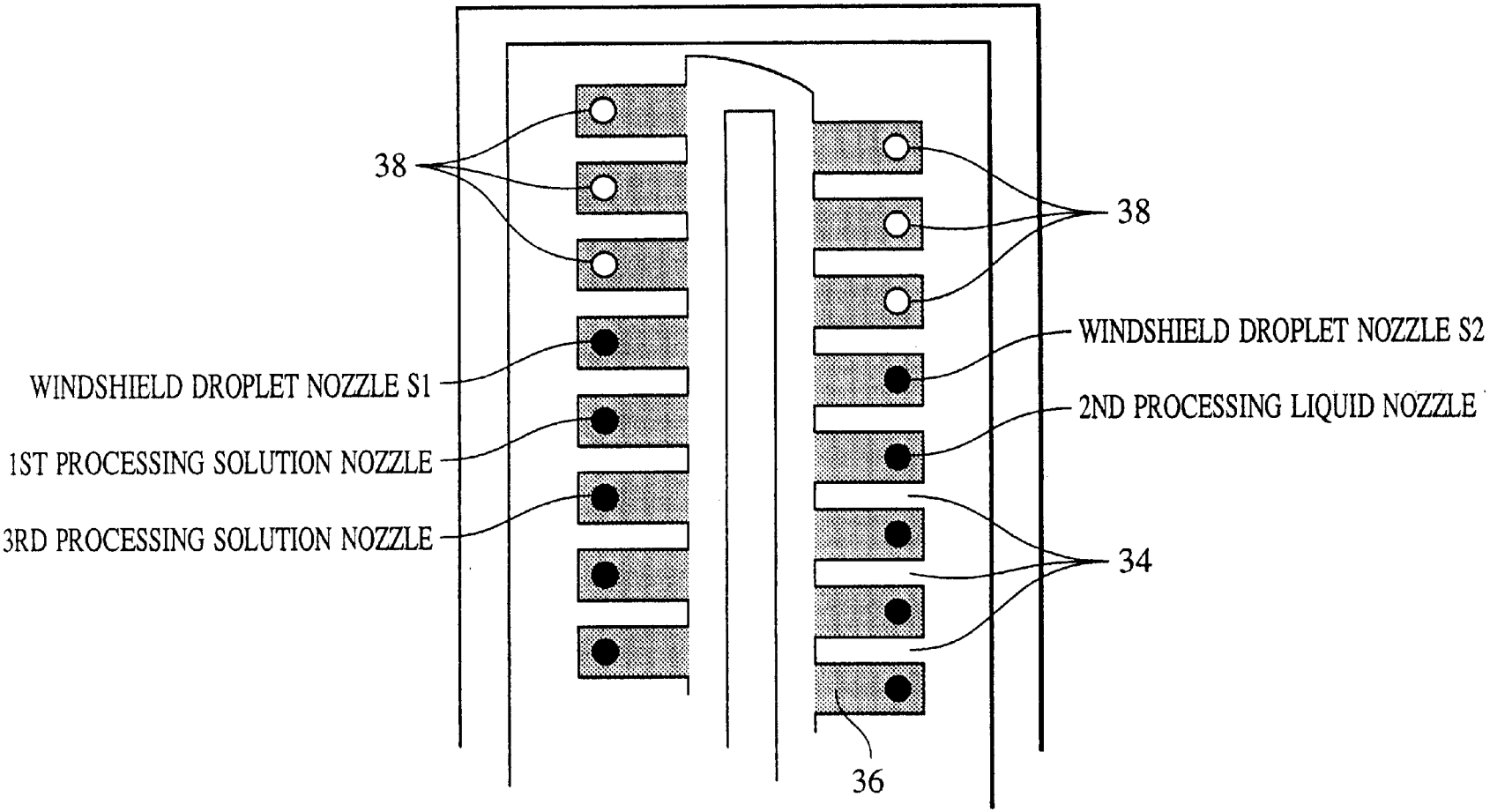
FIG. 13 is a plan view of the top of an ink jet head according to the second embodiment of the present invention.

FIG. 12 shows a recording head unit used in a second embodiment. This recording head unit is characterized by the use of a processing liquid (S) chip 2301 for discharging a processing liquid which insolubilizes or coagulates coloring agents in the inks. That is, this unit includes the S chip 2301, a black (Bk) chip 2302, a cyan (C) chip 2303, a magenta (M) chip 2304, and a yellow (Y) chip 2305, which are fixed on a frame 2306. These chips 2301 to 2305 have the same configuration as that of the print heads 30K, 30C, 30M, and 30Y in FIGS. 3A and 3B. These chips are arranged side-by-side in the main scanning direction at intervals of ½ inch. Each chip has a nozzle array including 256 nozzles (each nozzle is the same as the nozzle 37 shown in FIG. 4). These nozzles in the nozzle array are aligned in a direction substantially perpendicular to the main scanning direction. In the second embodiment, a cyan solid image was printed. Processing liquid dots were preliminarily formed at target positions for ink dots which would be formed later thereon to insolubilize or coagulate the discharged inks. In the chip 2301, the nozzle array consisted of two nozzle rows each including 128 nozzles, and these two rows were arranged in a staggered form. Referring to FIG. 13, the six end nozzles were used as dummy nozzles 38 and all the other inner nozzles were used as processing liquid nozzles.

In FIG. 13, nozzles S1 and S2 at the top end and unshown nozzles and S3 and S4 at the bottom end were used for discharging the windshield liquid droplets to prevent displacement of the processing liquid droplets discharged from the other inner nozzles. The configuration of the black (Bk) chip 2302, the cyan (C) chip 2303, the magenta (M) chip 2304, and the yellow (Y) chip 2305 were the same as that shown in FIGS. 6A and 6B in the first embodiment.

In both the processing liquid (S) chip 2301 and the cyan (C) chip 2303, the windshield droplets discharged from the windshield droplet discharge nozzles S1, S2, S3, and S4 moderate the effect of the crosswind during the solid-image printing in the full discharge mode. As a result, each of the processing liquid droplets and the corresponding ink droplets can be discharged to the target positions, facilitating the insolubilization or coagulation of the coloring agent in the ink.

Also, in this case, the displacement of the windshield liquid droplets discharged from the windshield droplet nozzles S1 to S4 from the target positions was adjusted to be about one quarter of the nozzle pitch. As a result, the windshield droplet dots discharged from the nozzles S1, S2, S3, and S4 and the ink droplets reached the corresponding target positions.

As described above, in the solid-image printing which is performed using the head according to the second embodiment, displacement or disorder cannot be visually observed in the arrangement of the processing liquid dots and the corresponding ink dots formed thereon. The printed solid image is of good quality and will not appear to have uneven density from a macroscopic viewpoint. Moreover, this image exhibits high moisture resistance.

In the second embodiment, the processing liquid dots are preliminarily formed. Alternatively, the processing liquid dots may be formed after discharging the ink droplets, or before and after discharging the ink droplets.

In the first and second embodiments, the processing liquid is used as the windshield liquid to avoid an increase in the number of liquid reservoirs. Of course, an additional reservoir may be provided to contain any liquid other than the processing liquid.

Control System Configuration

Figure 14:
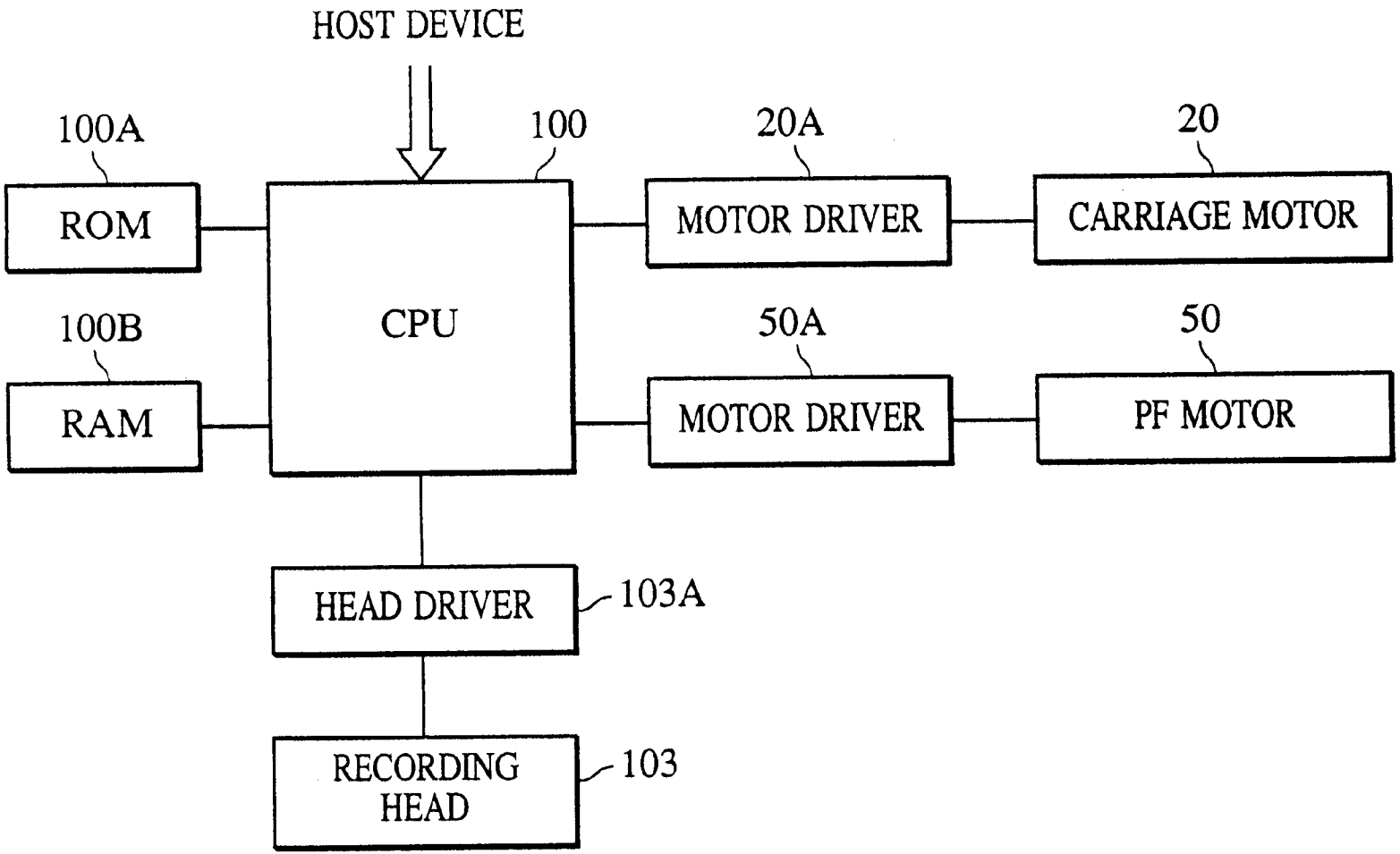
FIG. 14 is a block diagram illustrating a configuration of a control system for an ink jet recording apparatus according to the present invention.

FIG. 14 is a block diagram illustrating a configuration of a control system for the ink jet recording apparatus shown in FIG. 1.

A CPU 100 executes control processing and data processing for the operation of each unit of this apparatus. A ROM 100A stores a program for these processes. A RAM 100B is used as a work area for executing the above processes.

The CPU 100 supplies data for driving the electrothermal transducer and signals for controlling such driving to a head driver 103A to discharge ink droplets from the recording head unit 103. Also, the CPU 100 controls the discharge timing of the processing liquid, as described above. In addition, the CPU 100 controls the rotation of a carriage motor 20 for moving the above-described carriage 101 and a paper-feeding motor 50 for rotating a transfer roller via motor drivers 20A and 50A, respectively.

Ink

Preferred compositions of the inks used in the present invention will now be described.

Examples of water-soluble dyes containing anionic groups are as follows.

Examples of dyes used in the black ink include C.I. Direct Black 17, C.I. Direct Black 19, C.I. Direct Black 22, C.I. Direct Black 31, C.I. Direct Black 32, C.I. Direct Black 51, C.I. Direct Black 62, C.I. Direct Black 71, C.I. Direct Black 74, C.I. Direct Black 112, C.I. Direct Black 113, C.I. Direct Black 154, C.I. Direct Black 168, C.I. Acid Black 2, C.I. Acid Black 48, C.I. Acid Black 51, C.I. Acid Black 52, C.I. Acid Black 110, C.I. Acid Black 115, C.I. Acid Black 156, C.I. Reactive Black 1, C.I. Reactive Black 8, C.I. Reactive Black 12, C.I. Reactive Black 13, C.I. Food Black 1, and C.I. Food Black 2.

Examples of dyes used in yellow inks include C.I. Acid Yellow 11, C.I. Acid Yellow 17, C.I. Acid Yellow 23, C.I. Acid Yellow 25, C.I. Acid Yellow 29, C.I. Acid Yellow 42, C.I. Acid Yellow 49, C.I. Acid Yellow 61, C.I. Acid Yellow 71, C.I. Direct Yellow 12, C.I. Direct Yellow 24, C.I. Direct Yellow 26, C.I. Direct Yellow 44, C.I. Direct Yellow 86, C.I. Direct Yellow 87, C.I. Direct Yellow 98, C.I. Direct Yellow 100, C.I. Direct Yellow 130, and C.I. Direct Yellow 142.

Examples of dyes used in magenta inks include C.I. Acid Red 1, C.I. Acid Red 6, C.I. Acid Red 8, C.I. Acid Red 32, C.I. Acid Red 35, C.I. Acid Red 37, C.I. Acid Red 51, C.I. Acid Red 52, C.I. Acid Red 80, C.I. Acid Red 85, C.I. Acid Red 87, C.I. Acid Red 92, C.I. Acid Red 94, C.I. Acid Red 115, C.I. Acid Red 180, C.I. Acid Red 254, C.I. Acid Red 256, C.I. Acid Red 289, C.I. Acid Red 315, C.I. Acid Red 317, C.I. Direct Red 13, C.I. Direct Red 17, C.I. Direct Red 23, C.I. Direct Red 28, C.I. Direct Red 31, C.I. Direct Red 62, C.I. Direct Red 79, C.I. Direct Red 81, C.I. Direct Red 83, C.I. Direct Red 89, C.I. Direct Red 227, C.I. Direct Red 240, C.I. Direct Red 242, and C.I. Direct Red 243.

Examples of dyes used in cyan inks include C.I. Acid Blue 9, C.I. Acid Blue 22, C.I. Acid Blue 40, C.I. Acid Blue 59, C.I. Acid Blue 93, C.I. Acid Blue 102, C.I. Acid Blue 104, C.I. Acid Blue 113C.I. Acid Blue 117, C.I. Acid Blue 120, C.I. Acid Blue 167, C.I. Acid Blue 229, C.I. Acid Blue 234, C.I. Acid Blue 254 C.I. Direct Blue 6C.I. Direct Blue 22 C.I. Direct Blue 25, C.I. Direct Blue 71, C.I. Direct Blue 78, C.I. Direct Blue 86, C.I. Direct Blue 90, C.I. Direct Blue 106, and C.I. Direct Blue 199.

Water-soluble organic solvents contained in the inks using the above water-soluble dyes as coloring agents may be the same as the water-soluble organic solvents used in the processing liquid. Preferred contents of these water-soluble organic solvents in the inks are substantially the same as those of the processing liquid. Also, preferred physical properties of the inks are substantially the same as those in the processing liquid. The surface tension of the ink is preferably higher than the surface tension of the processing liquid in the image formation according to the present invention. In such adjustment of the surface tension between the ink and the processing liquid, the processing liquid, which is preliminarily discharged on a recording medium, probably contributes to the uniform wettability of the ink which is discharged later on the recording medium.

In the case of using pigments as the coloring agents in the inks used in the present invention, the pigment content is preferably in the range of 1 to 20 weight percent and more preferably 2 to 12 weight percent of the total ink weight.

A typical example of pigments in the present invention is carbon black for black inks. Preferable carbon black is manufactured by, for example, a furnace process or a channel process, has a BET specific surface area in the range of 50 to 300 $m^2/g$, a DEP absorption the range of 40 to 150 ml/100 g, and a pH value in the range of 2 to 9, and contains a volatile component in the range of 0.5 to 10%. Examples of commercially available carbon blacks having such characteristics include No. 2300, No. 900, MCF 88, No. 33, No. 40, No. 45, No. 52, MA 7, MA 8, and No. 2200B (made by Mitsubishi Chemical Corporation); RAVEN 1255 (made by Columbia Chemicals Co.); REGAL 400R, REGAL 330R, and REGAL 660R, MOGUL L (made by Cabot Corp.); and Color Black FW1, Color Black FW18, Color Black S150, Printex 35, and Printex U (made by Degussa AG).

Examples of pigments used in yellow inks include C.I. Pigment Yellow 1, C.I. Pigment Yellow 2, C.I. Pigment Yellow 3, C.I. Pigment Yellow 13, C.I. Pigment Yellow 16, and C.I. Pigment Yellow 83. Example of pigments used in magenta inks include C.I. Pigment Red 5, C.I. Pigment Red 7, C.I. Pigment Red 12, C.I. Pigment Red 48(Ca), C.I. Pigment Red 48(Mn), C.I. Pigment Red 57(Ca), C.I. Pigment Red 112, and C.I. Pigment Red 122. Examples of pigments used in cyan inks include C.I. Pigment Blue 1, C.I. Pigment Blue 2, C.I. Pigment Blue 3, C.I. Pigment Blue 15:3, C.I. Pigment Blue 16, C.I. Pigment Blue 22, C.I. Vat Blue 4, and C.I. Vat Blue 6. Any pigment other than those described above may also be used in the present invention. In addition, any novel pigment may be used in the present invention.

Any water-soluble dispersant which facilitates the dispersion of the pigment into the ink may be used in the present invention. The water-soluble dispersant preferably has a weight average molecular weight in the range of 1,000 to 30,000 and more preferably in the range of 3,000 to 15,000. Examples of such dispersants include block, random, and graft copolymers and salts thereof, each comprising at least two monomers (one being hydrophilic) selected from styrene and derivatives thereof, vinylnaphthalene and derivatives thereof, aliphatic alcohol esters of α,β-ethylenically unsaturated carboxylic acids, acrylic acid and derivatives thereof, maleic acid and derivatives thereof, itaconic acid and derivatives thereof, fumaric acid and derivatives thereof, vinyl acetate, vinylpyrrolidone, acrylamide, and derivatives thereof. Examples of other preferable dispersants are natural resins such as rosin, shellac, and starch. These resins are soluble in an aqueous alkaline solution. The content of the water-soluble resin as the dispersant is preferably in the range of 0.1 to 5 weight percent of the total ink weight.

Inks containing the above-described pigments are preferably controlled to be neutral or alkaline to improve the solubility of the water-soluble resin dispersants and thus to improve storage stability over long terms. The pH of the ink is preferably in the range of 7 to 10 to prevent corrosion of components constituting the ink jet recording apparatus.

Examples of pH modifiers used for adjusting the pH of the inks include organic amines such as diethanolamine and triethanol amine; alkali metal oxides such as sodium hydroxide, lithium hydroxide, and potassium hydroxide; organic acids; and mineral acids. The above-described pigments and water-soluble resins as dispersants are dispersed or dissolved into aqueous solvents.

Examples of aqueous solvents used in the present invention are mixtures of water and water-soluble organic solvents. Preferable water is ion-exchanged or deionized water.

Examples of water-soluble organic solvents used together with water include C1 to C4 alkyl alcohols, e.g., methyl alcohol, ethyl alcohol, n-propyl alcohol, isopropyl alcohol, n-butyl alcohol, sec-butyl alcohol, and tert-butyl alcohol; amides, e.g., dimethylformamide and dimethylacetamide; ketones and ketoalcohols, e.g., acetone and diacetone alcohol; ethers, e.g., tetrahydrofuran and dioxane; polyalkylene glycols, e.g., polyethylene glycol and polypropylene glycol; alkylene glycols having C2 to C6 alkylene groups, e.g., ethylene glycol, propylene glycol, butylene glycol, triethylene glycol, 1,2,6-hexanetriol, thiodiglycol, hexylene glycol, and diethylene glycol; glycerin; lower alkyl ethers of polyvalent alcohols, e.g., ethylene glycol monomethyl (or monoethyl) ether, diethylene glycol monomethyl (or monoethyl) ether, and triethylene glycol monomethyl (or monoethyl) ether; N-methyl-2-pyrrolidone; 2-pyrrolidone; and 1,3-dimethyl-2-imidazolidinone. Among these, polyvalent alcohols such as diethylene glycol and lower alkyl ethers of polyvalent alcohols such as triethylene glycol monomethyl (or monoethyl) ether are preferable.

The content of the water-soluble organic solvent in the ink is generally in the range of 3 to 50 weight percent and preferably in the range of 3 to 40 weight percent. The water content in the ink is generally in the range of 10 to 90 weight percent and preferably 30 to 80 weight percent.

The pigment-containing ink according to the present invention may further contain a surfactant, a defoaming agent, an anticeptic agent, and the like, depending on required properties. Furthermore, the pigment-containing ink may contain the above-described water-soluble dye, if necessary. In addition, the surface tension of the pigment-containing ink is preferably adjusted to be larger than the surface tension of the processing liquid.

The pigment-containing ink may be prepared, for example, as follows. After a pigment is added to an aqueous medium containing water and a water-soluble resin as a dispersant, these are stirred and then subjected to a dispersion process which is described below. The dispersion may be subjected to centrifugal separation, if necessary. A sizing agent and some of the above-mentioned additives are added to the resulting dispersion to prepare an ink used in the present invention.

The above-mentioned alkali-soluble resin as the dispersant is used together with a base which dissolves the resin into the solution. Examples of bases preferably used in this process include organic amines such as monoethanolamine, diethanolamine, triethanolamine, aminomethylpropanol, and ammonia and inorganic bases such as potassium hydroxide and sodium hydroxide.

In the preparation of the pigment-containing ink, premixing for at least 30 minutes is effective before dispersion of an aqueous pigment-containing medium. Such premixing improves wettability of the pigment particle surface and thus facilitates adsorption of the dispersant onto the pigment surface.

The dispersion of the pigment may be performed by any known dispersing device. Examples of such devices are ball mills and sand mills. Among these, high-speed sand mills are preferably used. Examples of this type of sand mill include Super Mill, Sand Grinder, Beads Mill, Agitator Mill, Grain Mill, Dynomill, Pearl Mill, and Cobol Mill (all being commercial names).

When the pigment-containing ink is used for ink jet recording, the pigment preferably has an optimized particle size distribution to prevent ink clogging at the nozzles. A pigment having a desired particle size distribution may be prepared by using smaller pulverizing media in a dispersion device, by increasing the loading rate of the pulverizing media, by increasing the pulverizing time, decreasing the discharge rate, by classifying the pulverized particles with a filter or a centrifugal separator, or combining these.

When the pigment-containing ink is used in the present invention, the ink preferably contains an anionic compound, for example, an anionic surfactant or an anionic polymer. If the pigment-containing ink contains no anionic dispersants, such an anionic compound must be added to the ink. In this case, the content of the anionic compound is in the range of 0.05 to 10 weight percent and preferably 0.2 to 5 weight percent.

Alternatively, the pigment-containing ink may contain an ampholytic surfactant of which the pH is preliminarily adjusted to the isoelectric point or less. In this case, the following known anionic surfactants may be used: carboxylate salt type, sulfate ester type, sulfonic acid type, and phosphate ester type. Nonlimiting examples of anionic polymers include alkaline-soluble resins, such as sodium polyacrylate and a copolymer containing partial acrylate segments.

Relationship Between Processing Liquid and Ink

A preferable relationship between the processing liquid and the ink used in the present invention will now be described.

The processing liquid for insolubilizing ink dyes may be prepared as follows. After preparing a solution composed of the ingredients listed below, the solution is filtered under pressure with a membrane filter having a pore size of 0.22 μm (Commercial Name: Fluoropore Filter, made by Sumitomo Electric Industries, Ltd.), and the pH of the solution is adjusted to 4.8 with sodium hydroxide to prepare Processing Solution A1.

| Ingredients of Al | |
|---|---|
| Low molecular weight component of cationic compound: Stearyltrimethylammonium salt (Trade Name: Electro-Stripper QE, made by Kao Corporation) or Stearyltrimethylammonium chloride (Trade Name: Utamine 86P, made by Kao Corporation) | 2.0 parts by weight |
| High molecular weight component of cationic compound: Copolymer of diallyamine hydrochloric acid and sulfur dioxide (Average Molecular Weight: 5000, Trade Name: Polyamine Sulfone PAS-92, made by Nitto Boseki Co., Ltd.) | 3.0 parts by weight |
| Thiodiglycol | 10 parts by weight |
| Water | the balance |

Inks which are insolubilized by the reaction with the processing liquid may be prepared as follows. The ingredients listed below are mixed and each solution is filtered under pressure with a membrane filter having a pore size of 0.22 μm (Commercial Name: Fluoropore Filter, made by Sumitomo Electric Industries, Ltd.) to prepare a yellow ink Y1, a magenta ink M1, a cyan ink C1, and a black ink K1.

| Y1: | |
|---|---|
| C.I. Direct Yellow 142 | 2 parts by weight |
| Thiodiglycol | 10 parts by weight |
| ethylene oxide-2,4,7,9-tetramethyl-5-decyne-4,7-diol (Trade name: Nonionic Surfactant Acetylenol E-H, made by Kawaken Fine Chemicals Co., Ltd.) | 0.05 parts by weight |
| Water | the balance |

M1:

The same as Y1, but using 2.5 parts by weight of C.I. Acid Red 289 instead of C.I. Direct Yellow 142.

C1:

The same as Y1, but using 2.5 parts by weight of C.I. Acid Blue 9 instead of C.I. Direct Yellow 142.

K1:

The same as Y1, but using 3 parts by weight of C.I. Food Black 2 instead of C.I. Direct Yellow 142.

In the present invention, the processing liquid and the ink are mixed on and/or in a recording medium. In the first stage of the reaction, the low molecular weight component (or oligomer) of the cationic compound in the processing liquid is instantaneously associated with the water-soluble dye with anionic groups in the ink to cause segregation of the aggregate from the liquid phase.

At the second stage of the reaction, the aggregate of the dye and the low molecular weight cationic component are absorbed in the polymer component in the processing liquid to increase the size of the aggregate. As a result, the aggregate barely penetrates into interstices between fibers of the recording medium. Since only the liquid component penetrates into the recording medium, compatibility between high print quality and rapid fixing is achieved. Since the aggregate formed in the above process is of high viscosity, the aggregate does not follow the penetration and diffusion of the liquid, thus preventing bleeding and color mixing between different color inks during full-color printing in the solid-image forming mode. Since the aggregate is insoluble in water, the resulting image exhibits high water and moisture resistance. Also the aggregate exhibits high light resistance due to a polymer shielding effect.

The terms "insolubilization" and "coagulation" in the present invention represent the phenomena in both the first and second stages.

In the present invention, the ink need not necessarily contain the high molecular weight component of the cationic compound or the polyvalent metal salt or may contain only a minimum amount of such substance since this is an auxiliary component used to ensure the above effects. Thus, the ink according to the present invention keeps the color bright, unlike known inks which contain cationic polymers and polyvalent metal salts for improving water resistance.

Any recording medium may be used without limitation in the present invention. Examples of recording media preferably used are plain paper, such as copying paper and bond paper. Coated paper and transparent sheets (OHP transparent films) which are prepared for ink jet printing can be used. In addition, general wood free paper and gloss paper can be used.

Inks used in the present invention are not limited to dye inks, but may be pigment inks containing dispersed pigments. When using a pigment ink, a processing liquid which can coagulate the pigment is preferably used. Examples of pigment inks (yellow ink Y2, magenta ink M2, cyan ink C2, and black ink K2) which contain pigments and an anionic compound and can coagulate by the reaction with the colorless liquid Al will now be described.

Black Ink K2:

Using an aqueous anionic polymer P-1 solution (styrene-methacrylic acid-ethyl acrylate, acid value: 400, weight average molecular weight: 6,000, solid content: 20%, neutralizer: potassium hydroxide) as a dispersant, the substances listed below were fed into a batch upright sand mill (made by Aimex Co., Ltd.) and were dispersed with glass beads media with a diameter of 1 mm for 3 hours while being cooled. The viscosity of the dispersion was 9 cps, and the pH thereof was 10.0. The dispersion was subjected to centrifugal separation to remove coarse particles to prepare a carbon black dispersion in which the weight average particle diameter of the carbon black was 100 nm.

Composition of Carbon Black Dispersion

| | |
|---|---|
| Aqueous P-1 solution (solid component 20%) | 40 parts by weight |
| Carbon Black (Trade Name: Mogul L, made by Cabot Corporation) | 24 parts by weight |
| Glycerin | 15 parts by weight |
| Ethylene glycol monobutyl ether | 0.5 parts by weight |
| Isopropyl alcohol | 3 parts by weight |
| Water | 135 parts by weight |

The resulting mixture was thoroughly dispersed to prepare the pigment-containing black ink K2. The ink contained about 10% of solid component.

Yellow Ink Y2:

An aqueous anionic polymer P-2 solution (styrene-methacrylic acid-ethyl methacrylate, acid value: 280, weight average molecular weight: 11,000, solid content: 20%, neutralizer: diethanolamine) as a dispersant and the substances listed below were dispersed as in the black ink K2 to prepare a yellow dispersion in which the weight average particle diameter of the pigment was 103 nm.

Composition of Yellow Dispersion

| | |
|---|---|
| Aqueous P-2 solution (solid component 20%) | 35 parts by weight |
| C.I. Pigment Yellow 180 (Novoperm Yellow PH-G, made by Hoechst Aktiengessellscaft | 24 parts by weight |
| Triethylene glycol | 10 parts by weight |
| Diethylene glycol | 10 parts by weight |
| Ethylene glycol monobutyl ether | 1.0 parts by weight |
| Isopropyl alcohol | 0.5 parts by weight |
| Water | 135 parts by weight |

The resulting mixture was thoroughly dispersed to prepare the ink jet yellow ink Y2. The ink contained about 10% of solid component.

Cyan Ink C2:

The aqueous anionic polymer P-1 solution used in the preparation of the black ink K2 as a dispersant and the substances listed below were dispersed as in the black ink K2 to prepare a cyan dispersion in which the weight average particle diameter of the pigment was 120 nm.

Composition of Cyan Dispersion

| | |
|---|---|
| Aqueous P-1 solution (solid component 20%) | 30 parts by weight |
| C.I. Pigment Blue 15:3 (Fastogen Blue FGF, made by Dainippon Ink and Chemicals, Incorporated) | 24 parts by weight |
| Glycerin | 15 parts by weight |
| Diethylene glycol monobutyl ether | 1.0 parts by weight |
| Isopropyl alcohol | 3 parts by weight |
| Water | 135 parts by weight |

The resulting mixture was thoroughly dispersed to prepare the ink jet cyan ink C2. The ink contained about 9.6% of solid component.

Magenta Ink M2:

The aqueous anionic polymer P-1 solution used in the preparation of the black ink K2 as a dispersant and the substances listed below were dispersed as in the black ink K2 to prepare a magenta dispersion in which the weight average particle diameter of the pigment was 115 nm.

Composition of Magenta Dispersion

| | |
|---|---|
| Aqueous P-1 solution (solid component 20%) | 20 parts by weight |
| C.I. Pigment Red 122 (made by Dainippon Ink and Chemicals, Incorporated) | 24 parts by weight |
| Glycerin | 15 parts by weight |
| Isopropyl alcohol | 3 parts by weight |
| Water | 135 parts by weight |

The resulting mixture was thoroughly dispersed to prepare the ink jet magenta ink M2. The ink contained about 9.2% of solid component.

Miscellaneous

The ink jet recording method and apparatus according to the present invention is particularly advantageous when using a recording head having means which generates thermal energy, for example, an electrothermal transducer or laser light, for discharging ink, in order to achieve high-density and high-resolution recording.

Typical configurations and principles of such ink jet recording are disclosed in, for example, U.S. Pat. Nos. 4,723,129 and 4,740,796. These methods can be applied to both an on-demand type system and a continuous type system, and are particularly suitable for the on-demand type system in which at least one driving signal is applied to an electrothermal transducer, which is arranged in a channel containing liquid or ink, in response to recording information to generate thermal energy which rapidly causes film boiling and thus bubble formation in the liquid or ink. The liquid or ink is discharged as at least one droplet through a nozzle by the growth and shrinkage effect of the bubble. By using a pulsed driving signal, the growth and shrinkage of the bubble is rapidly achieved; hence, the liquid or ink is instantaneously discharged in response to the driving signal. Preferable pulsed driving signals are disclosed in, for example, U.S. Pat. Nos. 4,463,359 and 4,345,262. The ink jet recording will be further improved under the conditions regarding the rate of temperature rise on the heating surface disclosed in U.S. Pat. No. 4,313,124.

The recording head used in the present invention may have any combination of nozzles, (linear or rectangular) channels, and electrothermal transducers disclosed in the above patents. Alternatively, the recording head may have any configuration disclosed in U.S. Pat. Nos. 4,558,333 and 4,459,600 in which a heating unit is arranged at a bent portion. Also, the recording head may have any configuration disclosed in Japanese Laid-Open Patent Publication No. 59-123670 in which a plurality of electrothermal transducers is provided for a common slit as a discharge section and Japanese Laid-Open Patent Publication No. 59-138461 in which an opening corresponding to a nozzle is provided to absorb pressure waves due to thermal energy. The method and apparatus according to the present invention is applicable to any recording head.

In addition, the method and apparatus according to the present invention is suitable for a recording head of a full-line type which has a length corresponding to the maximum length of the recording medium. Such a length may be achieved by a combination of a plurality of recording head units or by a single integrated recording head.

Moreover, the method and apparatus according to the present invention is applicable to any serial type of recording head, for example, a recording head fixed to the apparatus body, a detachable chip recording head which is electrically connected to the apparatus body and receives ink from the apparatus body after attachment, or a cartridge recording head with ink reservoirs.

Preferably, the recording apparatus according to the present invention further includes a recovery section for recovering discharge ability of the recording head and other auxiliary components. Examples of such components are, for example, capping and cleaning devices for the recording head, pressurizing or suction devices, an auxiliary heating device including an electrothermal transducer, another heating element, or a combination thereof, and an auxiliary discharge device for performing discharge other than recording.

The type and number of recording heads mounted are not limited in the present invention. For example, a single recording head may be provided for a single ink. Alternatively, a plurality of recording heads may be provided corresponding to a plurality of inks having different colors or densities. The present invention is applicable to both a monochrome recording mode which records with a main color such as black and a full-color recording mode which records with different colors or color mixing using an integrated recording head or a combination of recording heads.

In the present invention, the ink is described as liquid. However, the ink may be solid at a temperature below room temperature. In such a case, the ink is softened or melted at room temperature. In general, the ink may be maintained at a temperature in the range of 30° C. to 70° C. to stabilize the viscosity of the discharged ink. Thus, the ink may be solid as long as the ink is melted at this temperature in use. The solid ink prevents an excess increase in temperature due to the heat of fusion when being discharged and barely evaporates when not being discharged. Such an ink may be solidified when the ink reaches the recording medium. This ink may be retained in indents and pores in a porous sheet opposing an electrothermal transducer, as disclosed in Japanese Laid-Open Patent Publication Nos. 54-56847 and 60-71260. The method and apparatus according to the present invention are most suitable for a film boiling type of recording head, as described above.

Other preferred embodiments of the ink jet recording apparatus according to the present invention include image output terminals of information processing units such as computers, combinations of copying machines and readers, and facsimile units having transmitting/receiving functions.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method of ink jet recording comprising the steps of:

discharging an ink from a recording head having at least one nozzle array including a plurality of nozzles for performing recording on a recording medium; and discharging a liquid other than ink from at least two nozzles of the at least one nozzle array of the recording head, wherein the ink is discharged from inner nozzles of the at least one nozzle array and the at least two nozzles for discharging the liquid are disposed at outside of the inner nozzles in the at least one nozzle array.

2. A method of ink jet recording according to claim 1, wherein the liquid other than ink is colorless liquid.

3. A method of ink jet recording according to claim 1, wherein the liquid other than ink comprises a component insolubilizing or coagulating a coloring agent in the ink.

4. A method of ink jet recording according to claim 1, wherein the at least two nozzles comprise the outermost nozzles of the at least one nozzle array and a predetermined number of nozzles between the outermost nozzles and the inner nozzles.

5. A method of ink jet recording according to claim 4, wherein neither the ink nor the liquid other than ink is discharged from the outermost nozzles.

6. A method of ink jet recording according to claim 1, wherein the at least two nozzles comprise two outermost nozzles at both ends of the at least one nozzle array.

7. A method of ink jet recording according to claim 1, wherein said step of discharging the liquid other than ink is effected only when ink is discharged from all of the inner nozzles in said ink discharging step.

8. An ink jet recording apparatus comprising:

a recording head comprising at least one nozzle array including a plurality of nozzles, the plurality of nozzles comprising nozzles for discharging an ink and nozzles for discharging a liquid other than ink, wherein the liquid other than ink is discharged from at least two nozzles of the at least one nozzle array and the ink is discharged from inner nozzles adjacent to the at least two nozzles to perform recording onto a recording medium, the at least two nozzles being disposed at outside of the inner nozzles in the at least one nozzle array.

9. An ink jet recording apparatus according to claim 8, wherein the liquid other than ink is a colorless liquid.

10. An ink jet recording apparatus according to claim 8, wherein the liquid other than ink comprises a component insolubilizing or coagulating a coloring agent in the ink.

11. An ink jet recording apparatus according to claim 8, wherein the at least two nozzles comprise the outermost nozzles of the at least one nozzle array and a predetermined number of nozzles between the outermost nozzles and the inner nozzles.

12. An ink jet recording apparatus according to claim 11, wherein neither the ink nor the liquid other than ink is discharged from the outermost nozzles.

13. An ink jet recording apparatus according to claim 8, wherein the at least two nozzles comprise two outermost nozzles at both ends of the at least one nozzle array.

14. An ink jet recording apparatus according to claim 8, further comprising means for reciprocating said recording head in a main scanning direction, which is perpendicular to the direction of the at least one nozzle array, and means for conveying the recording medium in a sub scanning direction, which is substantially perpendicular to the main scanning direction.

15. An ink jet recording apparatus according to claim 8, wherein said recording head comprises a thermal energy generating unit which generates thermal energy to discharge the color ink and the liquid other than ink.

16. An ink jet recording apparatus according to claim 15, wherein the thermal energy generating unit comprises an electrothermal transducer for generating the thermal energy.

17. An ink jet recording apparatus according to claim 8, further comprising a controller to control said recording head to discharge the liquid other than ink only when the ink is ejected from all of the inner nozzles.

* * * * *